US005811920A

United States Patent [19]

Wada et al.

[11] Patent Number: 5,811,920

[45] Date of Patent: Sep. 22, 1998

[54] FLUORESCENT DISPLAY TUBE

[75] Inventors: Hiroyuki Wada; Yoshikazu Shibuya; Hiroshi Yamaguchi, all of Mobara, Japan

[73] Assignee: Futaba Denshi Kogyo K.K., Mobara, Japan

[21] Appl. No.: 756,685

[22] Filed: Nov. 26, 1996

[30] Foreign Application Priority Data

Nov. 28, 1995 [JP] Japan ..... 7-309349

[51] Int. Cl.[6] ..... H01J 29/70; H01J 1/62; H01J 63/04

[52] U.S. Cl. ..... 313/422; 313/496

[58] Field of Search ..... 313/256, 257, 313/278, 422, 487, 491, 492, 496, 497

[56] References Cited

U.S. PATENT DOCUMENTS

| | | | |
|---|---|---|---|
| 4,531,122 | 7/1985 | Redfield | 313/422 |
| 4,540,983 | 9/1985 | Morimoto et al. | 313/492 |
| 4,973,889 | 11/1990 | Tomii et al. | 313/422 |
| 5,300,857 | 4/1994 | Imai et al. | 313/496 |

*Primary Examiner*—William L. Oen

*Attorney, Agent, or Firm*—Oblon, Spivak, McClelland, Maier & Neustadt, P.C.

[57] ABSTRACT

A fluorescent display tube having a structure in which only filament-shape cathodes corresponding to required display regions are selectively supplied with electric power and in which elongated cathode attaching plates are disposed apart from one another on an end of an anode substrate, a first support member is secured to the first cathode attaching plate disposed inwards when viewed in the lengthwise direction of the cathodes, while a second support member is secured to the second cathode attaching plate disposed outwardly. Each support member has a base portion secured to the cathode attaching plate, a securing portion for securing the cathode and a connection portion for connecting the base portion and the securing portion to each other. The plural cathodes are stretched to run parallel to one another. A connection portion of the inner support member is longer than a connection portion of an outer support member. The two support members secure the ends of the cathodes at the same positions. Operation voltage is supplied to each of the first or the second cathode attaching plate so that the cathodes divided into two groups are individually operated. Positions at which ends of the cathodes are aligned so that an end cool effect is made to be uniform.

4 Claims, 5 Drawing Sheets

FIG.3A
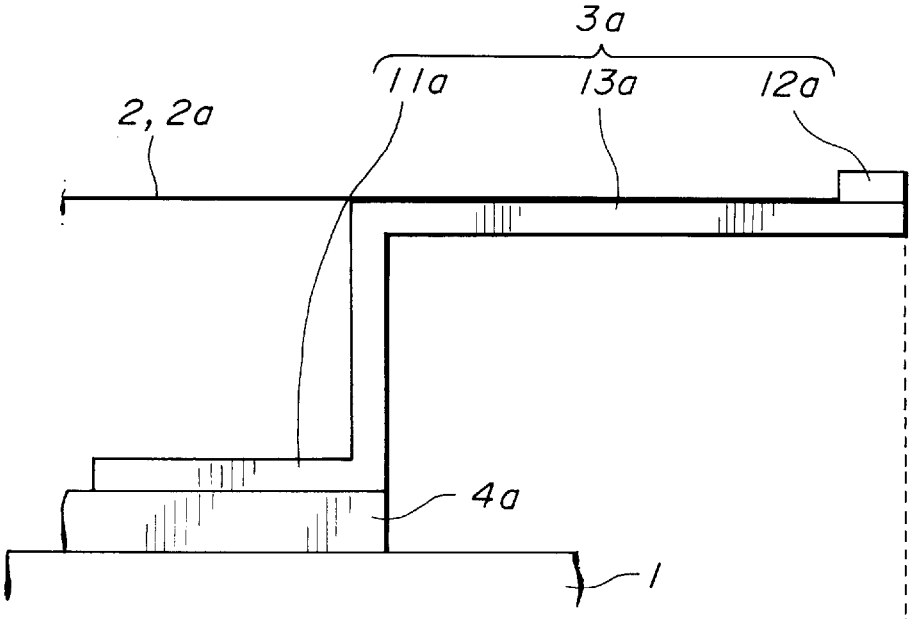
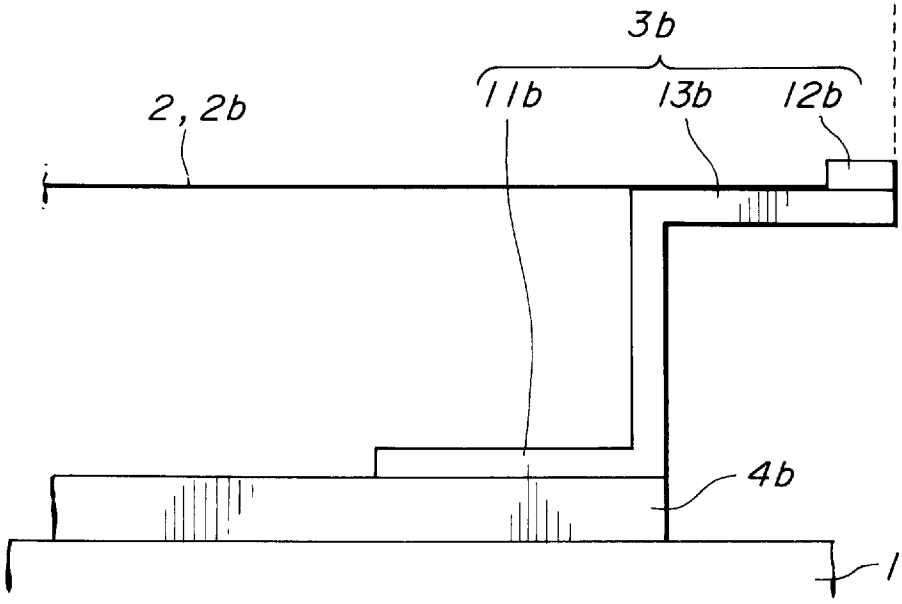
FIG.3B

FIG.4A
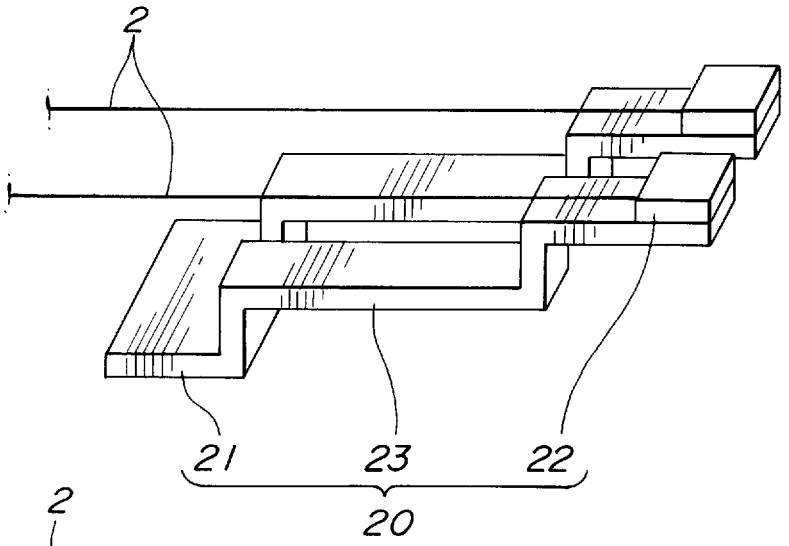
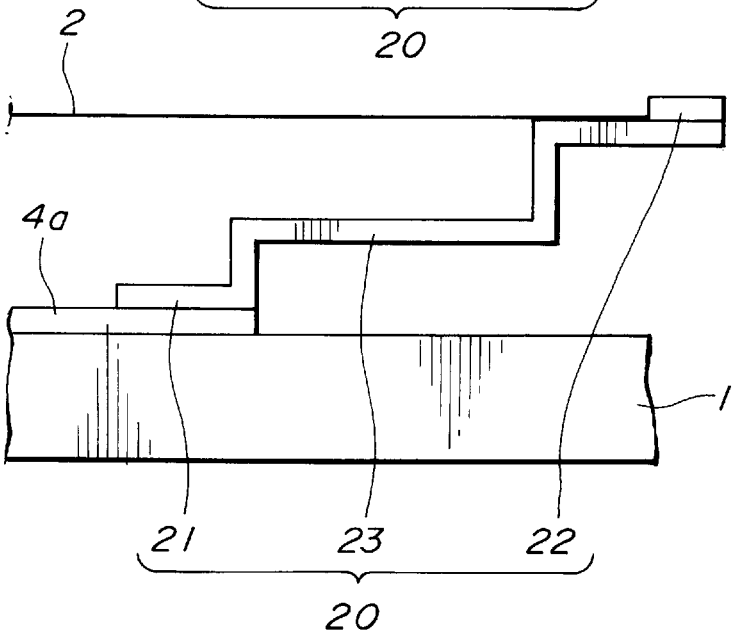
FIG.4B

FLUORESCENT DISPLAY TUBE

BACKGROUND OF THE INVENTION

1. Field of the Invention

The present invention relates to a fluorescent display tube having a plurality of filament-type cathodes stretched by stretching members, and more particularly to a fluorescent display tube having a structure such that stretching members are divided at ends of cathodes to divide the cathodes into plural pairs so as to selectively be operated and the shapes of the divided pairs are made to be different from each other so as to make constant the state of end cool at the end of each cathode.

2. Description of the Related Art

A general fluorescent display tube has an envelope, the inside portion of which is maintained at high vacuum and which accommodates various electrodes and the like. Specifically, an anode is formed on the inner surface of a substrate forming a portion of the envelope. In general, the anode consists of an anode conductor formed on the substrate and a fluorescent layer with which the anode conductor is coated. A control electrode is formed above the anode. Filament-shape cathodes are formed above the control electrode. Electrons emitted from the cathodes are accelerated and controlled by the control electrode so that electrons collide with the fluorescent layer of the anode to cause the fluorescent layer to emit light.

One or more filament-shape cathodes are employed to correspond to the display area of the fluorescent display tube. In a case where plural cathodes are employed, the cathodes are usually disposed to run parallel to one another. Two ends of the filament-shape cathodes are secured by pairs of stretching members. A usual stretching member has a support member for securing an end of the cathode and an anchoring member having elasticity to be capable of securing another end of the cathode and supplying tension to the cathode.

In recent years, the fluorescent display tube has been widely used and employed so as to be mounted on a vehicle. The display portion of the fluorescent display tube which is mounted on a vehicle includes display portions, such as the speedometer and the tachometer, which must always be displayed during driving and display portions, such as various alarm lamps, which are turned on only when required.

Hitherto, all cathodes corresponding to all of the display portions are supplied with electric power and display signals are supplied to the cathodes corresponding to required display portions so as to perform required display.

The foregoing conventional method of operating the fluorescent display tube has the structure such that operation electric currents are as well as supplied to cathodes corresponding to the portions which are not required to be turned on. Therefore, electric power has been wasted.

SUMMARY OF THE INVENTION

A first object of the present invention is to provide a fluorescent display tube having a plurality of filament-shape cathodes and structured such that electric power can be supplied to only cathodes corresponding to required display regions so as to save energy.

A second object of the present invention is to provide a fluorescent display tube having a plurality of filament-shape cathodes disposed to run parallel to one another and divided into plural pairs so as to be selectively supplied with voltage and arranged such that positions at which ends of the cathodes are held by stretching members are aligned into a direction intersecting the lengthwise direction of the cathodes so as to make uniform a state where the ends of the cathodes are cooled by the stretching members.

According to a first aspect of the present invention, there is provided a fluorescent display tube including: an envelope, the inside portion of which is maintained at high vacuum; a plurality of cathodes in the form of filaments stretched in parallel to one another in the envelope; and plural pairs of stretching members for securing two ends of each of the cathodes in the envelope, wherein either side of the stretching members for securing the ends of the cathodes are divided into a plurality of groups electrically separated from one another and operation voltage can be applied to each of the groups.

According to a second aspect of the present invention, there is provided a fluorescent display tube including: an envelope, the inside portion of which is maintained at high vacuum; a plurality of cathodes in the form of filaments stretched in parallel to one another in the envelope; a plurality of cathode attaching plates disposed apart from one another in the lengthwise direction of the cathodes at an end of the envelope and ejected to the outside portion of the envelope so as to be independently applied with voltage for operating the cathodes; and a plurality of stretching members each of which is attached to each of the cathode attaching plates and which hold ends of the cathodes in such a manner that positions at which the cathodes are held are arranged to align in a direction intersecting the lengthwise direction of the cathodes.

According to a third aspect of the present invention, there is provided a fluorescent display tube according to the second aspect of the present invention, wherein the stretching member has a base portion secured to the cathode attaching plate, a securing portion for holding an end of the cathode and a connection portion for connecting the base portion and the securing portion to each other, wherein at least the base portions of the plural stretching members or the connection portions of the same have a different shape in order to align the securing portions of the plural stretching members in a direction intersecting the lengthwise direction of the cathodes.

According to a fourth aspect of the present invention, there is provided a fluorescent display tube according to the third aspect of the present invention, wherein the connection portion is not in contact with the cathode.

Other objects, features and advantages of the invention will be evident from the following detailed description of the preferred embodiments described in conjunction with the attached drawings.

BRIEF DESCRIPTION OF THE DRAWINGS

FIG. 3 is a side view showing an essential portion of the first embodiment of the present invention;

FIG. 4 is a perspective view and a side view showing an essential portion of a second embodiment of the present invention.

DESCRIPTION OF THE PREFERRED EMBODIMENTS

A first embodiment of the present invention will now be described with reference to FIGS. 1 to 3. A fluorescent display tube according to this embodiment is structured so as to be mounted on a vehicle. The fluorescent display tube according to this embodiment has a box-shape envelope formed by airtightly combining substrates made of insulating material. Air in the inside portion of the envelope is evacuated and thus the same is made to be high vacuum state in the manufacturing process.

Figure 1:
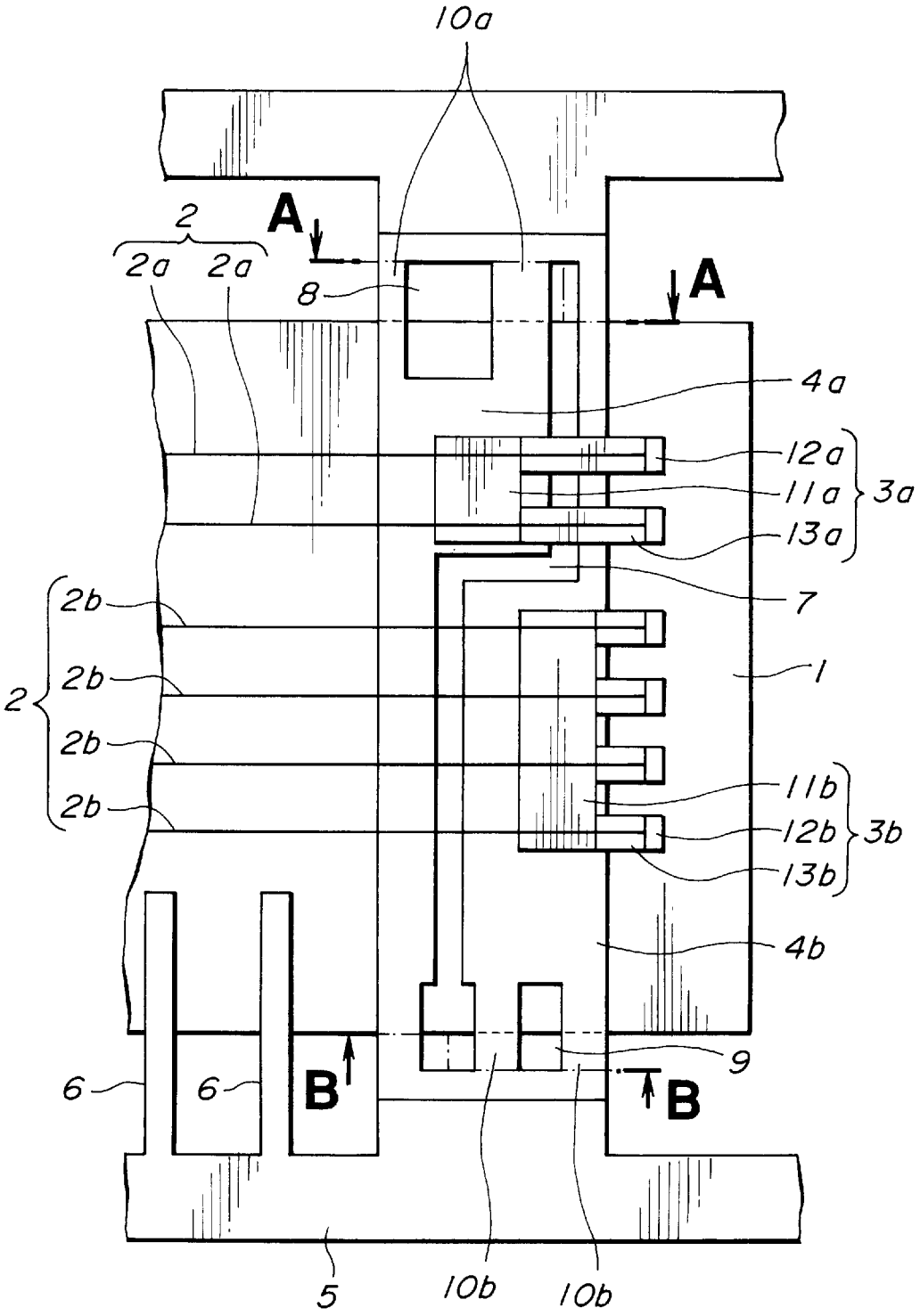
FIG. 1 is a plan view showing an essential portion of a first embodiment of the present invention.
Figure 2:
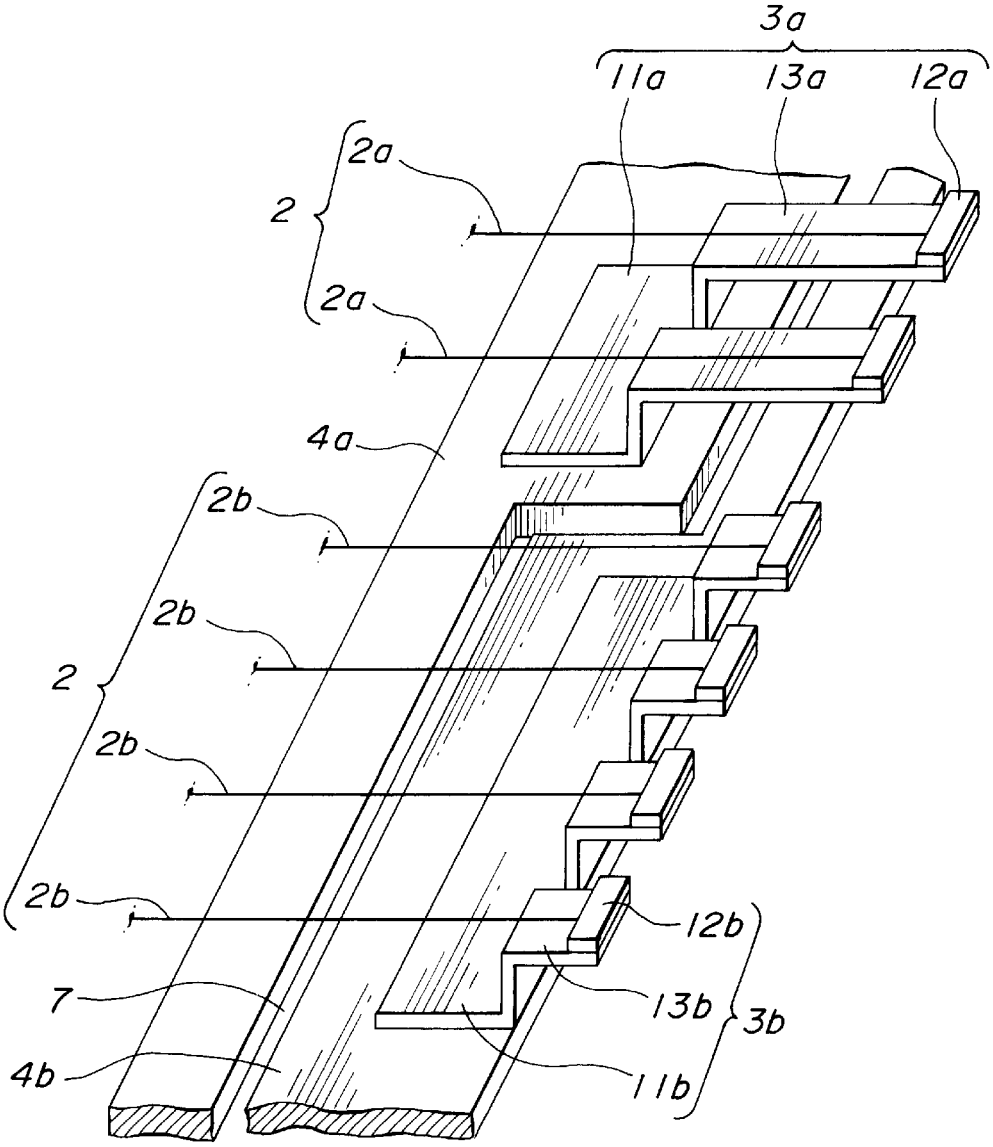
FIG. 2 is a perspective view showing an essential portion of the first embodiment of the present invention.

Referring to FIG. 1, reference numeral 1 represents a rectangular anode substrate 1 forming a portion of the envelope. Anode conductors and wire conductors (not shown), connected to the anode conductors, are formed on the anode substrate 1. Moreover, a fluorescent layer is applied to the upper surface of the anode conductor so that an anode serving as a light-emission display portion is formed. A control electrode (not shown) is formed on the anode.

As shown in FIG. 1, a plurality of filament-shape cathodes 2 are stretched to run parallel to one another at positions above the control electrodes of the anode substrate 1. Each of the cathodes 2 is stretched in the lengthwise direction of the rectangular anode substrate 1. The two ends of each of the cathodes 2 are secured to the two lengthwise directional ends of the anode substrate 1 by stretching members. The stretching member includes a support member 3 for securing an end of the cathode 2 and an anchor member for elastically holding the other end of the cathode 2 so as to apply a tension to the cathode 2.

As shown in FIG. 1, two cathode attaching plates 4*a* and 4*b* are disposed above the end of the rectangular anode substrate 1. Each of the cathode attaching plates 4*a* and 4*b* is a plate elongated in a direction (that is, the lengthwise direction of the anode substrate 1) perpendicular to the lengthwise direction of the cathodes 2, the cathode attaching plates 4*a* and 4*b* being disposed apart from each other at a predetermined interval in the lengthwise direction of the cathodes 2. The cathode attaching plates 4*a* and 4*b* are made of 426-alloy having a thermal expansion coefficient approximating that of glass.

Two ends of each of the cathode attaching plates 4*a* and 4*b* are connected to spacer frames 5 during the manufacturing process. The spacer frame 5 is a member formed into a rectangular shape and having electrode members and outer leads 6 of the fluorescent display tube attached thereto. The two cathode attaching plates 4*a* and 4*b* are opposite to each other while interposing a bent groove 7 except the two ends of the cathode attaching plates 4*a* and 4*b* in a state where the cathode attaching plates 4*a* and 4*b* are connected to the spacer frames 5. A rectangular through hole 8 is formed at an end of the first cathode-attaching-plate 4*a* connected to the spacer frames 5. Also a rectangular through hole 9 is formed at another end of the second cathode-attaching-plate 4*b* connected to the spacer frames 5 at a position opposite to the through hole 8 with respect to the anode substrate 1. By cutting the two ends of the two cathode attaching plates 4*a* and 4*b* along the cutting lines A—A and B—B shown in FIG. 1, the two cathode attaching plates 4*a* and 4*b* are left as connection terminals 10*a* and 10*b* each having an end which is branched into two sections, and then extended to the outside of the anode substrate 1.

A first support member 3*a*, which is a first stretching member, is secured to the first cathode-attaching-plate 4*a* located at an inner position with respect to the lengthwise direction of the cathodes 2. The first support member 3*a* has a base portion 11*a* which is secured to the first cathode-attaching-plate 4*a*. A substantially L-shape connection portion 13*a* is stood erect from the base portion 11*a*. A securing portion 12*a* is formed at the leading end of the connection portion 13*a*. An end of the cathode 2*a* is, by welding or the like, secured to the securing portion 12*a*. In this embodiment, the first support member 3*a* has the common base portion 11*a*, two connection portions 13*a* and two securing portions 12*a* so as to stretch two cathodes 2*a*.

A second support member 3*b*, which is a second stretching member, is secured to the second cathode-attaching-plate 4*b* located at an outer position with respect to the lengthwise direction of the cathodes 2. The second support member 3*b* has a base portion 11*b* which is secured to the second cathode-attaching-plate 4*b*. A substantially L-shape connection portion 13*b* is stood erect from the base portion 11*b*. A securing portion 12*b* is formed at the leading end of the connection portion 13*b*. An end of the cathode 2*b* is, by welding or the like, secured to the securing portion 12*b*. In this embodiment, the second support member 3*b* has the common base portion 11*b*, four connection portions 13*b* and four securing portions 12*b* so as to stretch four cathodes 2*a*.

The first support member 3*a* and the second support member 3*b* have the same structure because each of the support members 3*a* and 3*b* has the base portions 11*a* and 11*b* secured to the corresponding first and second cathode attaching plates 4*a* and 4*b*, the securing portions 12*a* and 12*b* for securing the ends of the cathodes 2*a* and 2*b* and the connection portions 13*a* and 13*b* for connecting the base portions 11*a* and 11*b* and the securing portions 12*a* and 12*b*. However, as shown in FIGS. 1 to 3, the first support member 3*a* secured inwards with respect to the lengthwise direction of the cathodes 2 has the connection portion 13*a* having a longer size, while the second support member 3*b* secured outwards with respect to the lengthwise direction of the cathodes 2 has the connection portions 13*b* having a shorter size. The difference in the length between the connection portions 13*a* and 13*b* of the two support portions 3*a* and 3*b* is determined in such a manner that the securing portions of the two support members 3*a* and 3*b* are aligned in a direction perpendicular to the lengthwise direction of the cathodes 2. That is, the support members 3*a* and 3*b*, mechanically divided so as to be individually operated by electric power, secure the ends of all of the cathodes 2 at the same positions in the lengthwise direction of the cathodes 2.

If the support members 3*a* and 3*b* have the same shape, the positions at which the two support members 3*a* and 3*b* secure the ends of the cathodes 2 are made to be different in the lengthwise direction of the cathodes 2. If the ends of the cathodes 2 are shifted, effective display areas corresponding to the respective cathodes 2 are unintentionally made to be different from one another. The reason for this is that a portion of generated heat is absorbed by the support member and the emission is therefore deteriorated at the ends of the cathodes 2. The foregoing phenomenon is called an "end cool effect". In this embodiment, all of the ends of the cathodes 2 are aligned so that the ends of the display areas are free from irregularities. As a result, the layout of each display portion can be determined significantly freely.

Another end of each of the cathodes 2 is anchored by the anchoring member so that appropriate tension is applied to each of the cathodes 2. Each of the anchoring members is secured to the common cathode attaching plate. The cathode attaching plate is ejected to the outside portion of the envelope so as to be connected to a cathode operation circuit.

The fluorescent display tube according to this embodiment is structured to be mounted on a vehicle such that the four cathodes 2*b* supported by the second support member 3*b* are used to always display images, such as display areas for the speedometer and the tachometer. On the other hand, the two cathodes 2*a* supported by the first support member 3*a* are cathodes for display portions which are not always displayed. Operation voltage supplied from the cathode operating circuit is always supplied to the cathodes 2*b* supported by the second support member 3*b* of the second cathode-attaching-plate 4*b*. Usually, electric power is not supplied to the cathode 2*a* supported by the first support member 3*a* of the first cathode-attaching-plate 4*a*. Only when a necessity of displaying an alarm lamp arises, operation voltage is supplied to the first cathode-attaching-plate 4*a* to which the first support member 3*a* is attached. Therefore, the fluorescent display tube according to this embodiment enables electric power to selectively be supplied to the cathode corresponding to a required display region. Thus, electric power can be saved.

However, since the support members 3*a* and 3*b*, as shown in FIG. 3, secure the ends of all of the cathodes 2 disposed to run parallel to one another at the same position in the lengthwise direction of the cathodes 2, the support members 3*a* and 3*b* have connection portions 13*a* and 13*b* having different lengths. The cathodes 2*a* and 2*b* are in contact with the horizontal portions of the connection portions 13*a* and 13*b* having the different lengths. Thus, it can be considered that heat of the cathodes 2 is also transmitted to the support members 3*a* and 3*b* in the above-mentioned portions. Since the length of contact with the cathode 2 is different, the quantity of heat deprived in the foregoing portion is different between the first support member 3*a* and the second support member 3*b*. Therefore, a consideration can be performed that degree of deterioration in the emission is different for each of the support members 3*a* and 3*b*.

Accordingly, as modifications of the embodiment shown in FIGS. 1 to 3, second and third embodiments will now be described with reference to FIGS. 4 and 5. These embodiments are modifications of the first support member 3*a* according to the first embodiment. A first support member 20 according to the second embodiment shown in FIG. 4 has a base portion 21, a securing portion 22 and a connection portion 23 arranged to connect the base portion 21 and the securing portion 22 to each other and bent in the stepped-shape. In a second support member (not shown), by making the length for which the connection portion is in contact with the cathodes 2 and the length of contact for which the horizontal portion of the securing portion of the connection portion 23 of the first support member 20 is in contact with the cathode 2 to be the same, the difference in the end cool effect occurring attributable to the difference in the shape of the support member does not arise.

Figure 5A:
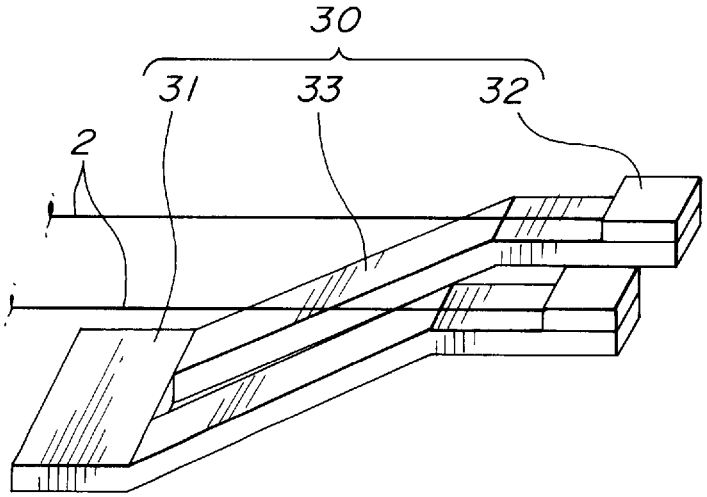
FIG. 5 is a perspective view and a side view showing an essential portion of a third embodiment of the present invention.
Figure 5B:
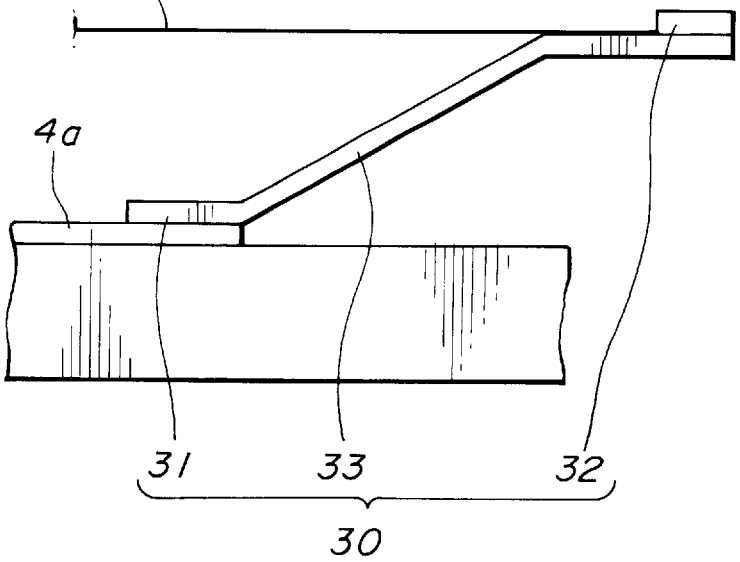

A first support member 30 according to the third embodiment shown in FIG. 5 has a base portion 31, a securing portion 32 and a connection portion 33 for connecting the base portion 31 and the securing portion 32 to each other. In a second support member (not shown), by making the length for which the connection portion is in contact with the cathodes 2 and the length of contact for which the horizontal portion of the securing portion of the connection portion 33 of the first support member 30 is in contact with the cathode 2 to be the same, the difference in the end cool effect occurring attributable to the difference in the shape of the support member does not arise.

The fluorescent display tube, according to the present invention and having a plurality of filament-shape cathodes, the two ends of which are secured by the stretching members, is structured such that either side of the stretching members for securing the ends of the cathodes are divided into a plurality of groups electrically separated from one another and operation voltage can be applied to each of the groups. Therefore, operation voltage can be applied to only required cathodes so that electric power is saved.

Moreover, the stretching member is secured to each of the plural cathode attaching plates disposed apart from one another in the lengthwise direction of the cathodes, and shape of the stretching members are determined in such a manner that the positions at which the ends of the cathodes are secured by the stretching members are aligned when viewed in the lengthwise direction of the cathodes. Therefore, the cool effect is obtained in the same portions of the plural cathodes divided electrically and mechanically. As a result, display irregularities in the display areas can be prevented.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A fluorescent display tube comprising:

an envelope, the inside portion of which is maintained at high vacuum;

a plurality of cathodes in the form of filaments stretched in parallel to one another in said envelope; and plural pairs of stretching members for securing two ends of each of said cathodes in said envelope, wherein either side of said stretching members for securing the ends of said cathodes are divided into a plurality of groups electrically separated from one another whereby different operating voltages can be applied to each of said groups.

2. A fluorescent display tube comprising:

an envelope, the inside portion of which is maintained at high vacuum;

a plurality of cathodes in the form of filaments stretched in parallel to one another in said envelope;

a plurality of cathode attaching plates, each elongated in a direction perpendicular to a lengthwise direction of said cathodes and disposed apart from one another in the lengthwise direction of said cathodes and extending to an outside portion of said envelope so as to be independently applied with voltage for operating said cathodes; and a plurality of stretching members each one of which is attached to one of said cathode attaching plates and which hold ends of said cathodes in such a manner that positions at which said cathodes are held are arranged to align in a direction intersecting the lengthwise direction of said cathodes.

3. A fluorescent display tube according to claim 2, wherein said stretching member has a base portion secured to said cathode attaching plate, a securing portion for holding an end of said cathode and a connection portion for connecting said base portion and said securing portion to each other, wherein at least said base portions of said plural stretching members or said connection portions of the same have a different shape in order to align said securing portions of said plural stretching members in a direction intersecting the lengthwise direction of said cathodes.

4. A fluorescent display tube according to claim 3, wherein said connection portion is not in contact with said cathode.

* * * * *